United States Patent [19]

Lu

[11] Patent Number: 4,939,868

[45] Date of Patent: Jul. 10, 1990

[54] DOOR HAVING A FRAME IN WHICH A SLIDING PIECE IS MOUNTED

[76] Inventor: Ching-Nan Lu, 16, Lane 83, Tsu-Chiang 1st Rd., Chien-Jin Dist., Kaohsiung, Taiwan

[21] Appl. No.: 343,076

[22] Filed: Apr. 25, 1989

[51] Int. Cl.[5] ..... E05D 7/08

[52] U.S. Cl. ..... 49/388; 16/235; 16/378

[58] Field of Search ..... 49/388, 501; 16/235, 16/237, 378

[56] References Cited

U.S. PATENT DOCUMENTS 2,777,173 1/1957 Caswall ..... 49/501 X
2,923,036 2/1960 Beyrle ..... 49/388
4,200,956 5/1980 Ullman, Jr. ..... 49/388 X
4,523,414 6/1985 Horgan, Jr. ..... 49/388 X

*Primary Examiner*—Philip C. Kannan
*Attorney, Agent, or Firm*—Brumbaugh, Graves, Donohue & Raymond

[57] ABSTRACT

A door has a frame mounted therearound for connecting with an engaging member mounted adjacent to an opening in a wall. The frame has a guiding channel and a connecting member installed in the guiding channel for connecting with the engaging member. A slide piece is slidably provided in the guiding channel and screws are introduced into the connecting member for interconnecting the connecting member and the slide piece, and thus immobilizing the slide piece, so that the slide piece permits adjustment of the location of the connecting member relative to the channel.

5 Claims, 5 Drawing Sheets

DOOR HAVING A FRAME IN WHICH A SLIDING PIECE IS MOUNTED

BACKGROUND OF THE INVENTION

This invention relates to a door with a frame provided therearound, and more particularly to a door wherein said frame has a guiding channel and a slidable connecting member mounted therein.

Referring to FIG. 1, a glass door 1 is provided with a frame 2 for mounting said door to a fixing seat 5 installed in a wall 6. The frame 2 has a guiding channel which is divided into an upper section 22 and a lower section 23 by means of a partition plate 21. A connecting member 3 is screwed to said partition plate 21 in the upper section 22 of the frame 2. To affix the frame 2 to the upper side of the glass door 1, silicone rubber 11 is applied in the lower section 23 of the frame 2. A mounting plate 4 is screwed to the connecting member 3 and has a mounting hole 42 formed therein. The mounting plate 4 is arranged so that a pivot pin 51, which is fixedly mounted in the fixing seat 5, can be inserted into the mounting hole 42 when the door 1 is positioned properly. Another frame is mounted to the lower side of the door in a similar manner with a similar structure. In this way, the door 1 can be pushed or pulled to rotate about the pivot pin 51 to an opened or closed position. However, the abovementioned known door suffers from some disadvantages in that, because the connecting member 3 and the mounting plate 4 are fixed to the frame 2 and the fixing screws 31 for fixing the connecting member 3 are sealed in the silicon rubber 11, the relative positions among the pivot pin 51 of the fixing seat 5, the mounting plate 4 and the connecting member 3 must be precisely predetermined in order to enable the pivot pin 51 to align with and insert into the mounting hole 42. A correction must be made when said relative positions are incorrect. That is, the screws 31 must be removed and then screwed into another proper position after the relative positions of the connecting member 3, the mounting plate 4 and the pivot pin 51 of the fixing seat 5 are rearranged to their respective correct relative positions. Such a correction is messy and may result in damage to parts of the door. It has been found that an automatic door which has a structure similar to that of the abovementioned door suffers from the same disadvantages.

SUMMARY OF THE INVENTION

It is therefore a main object of this invention to provide a door having a frame in which a slide piece is mounted so that the proper mounting position of the door can be easily achieved.

Accordingly, the door has a frame mounted therearound for connecting with an engaging member mounted adjacent to an opening of a wall. The frame has a guiding channel formed therein and a connecting member installed in said guiding channel for connecting with the engaging member. In accordance with the present invention, a slide piece is slidably provided in the guiding channel and a screw means provided with the connecting member for interconnecting said connecting member with the slide piece and thus immobilizing said slide piece, so that said slide piece permits the adjustment of the location of said connecting member relative to said channel. By this means, the relative position between the connecting member of the door and the engaging member of the wall can be easily corrected by releasing the screw means and moving the slide piece.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
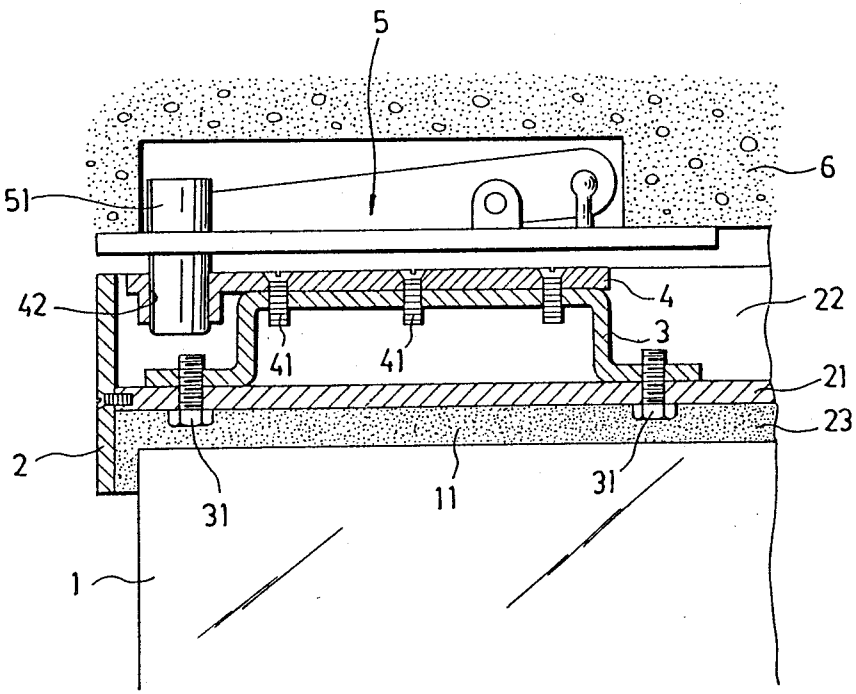
FIG. 1 PRIOR ART
FIG. 1 is a sectional view of a portion of a conventional glass door.
Figure 2:
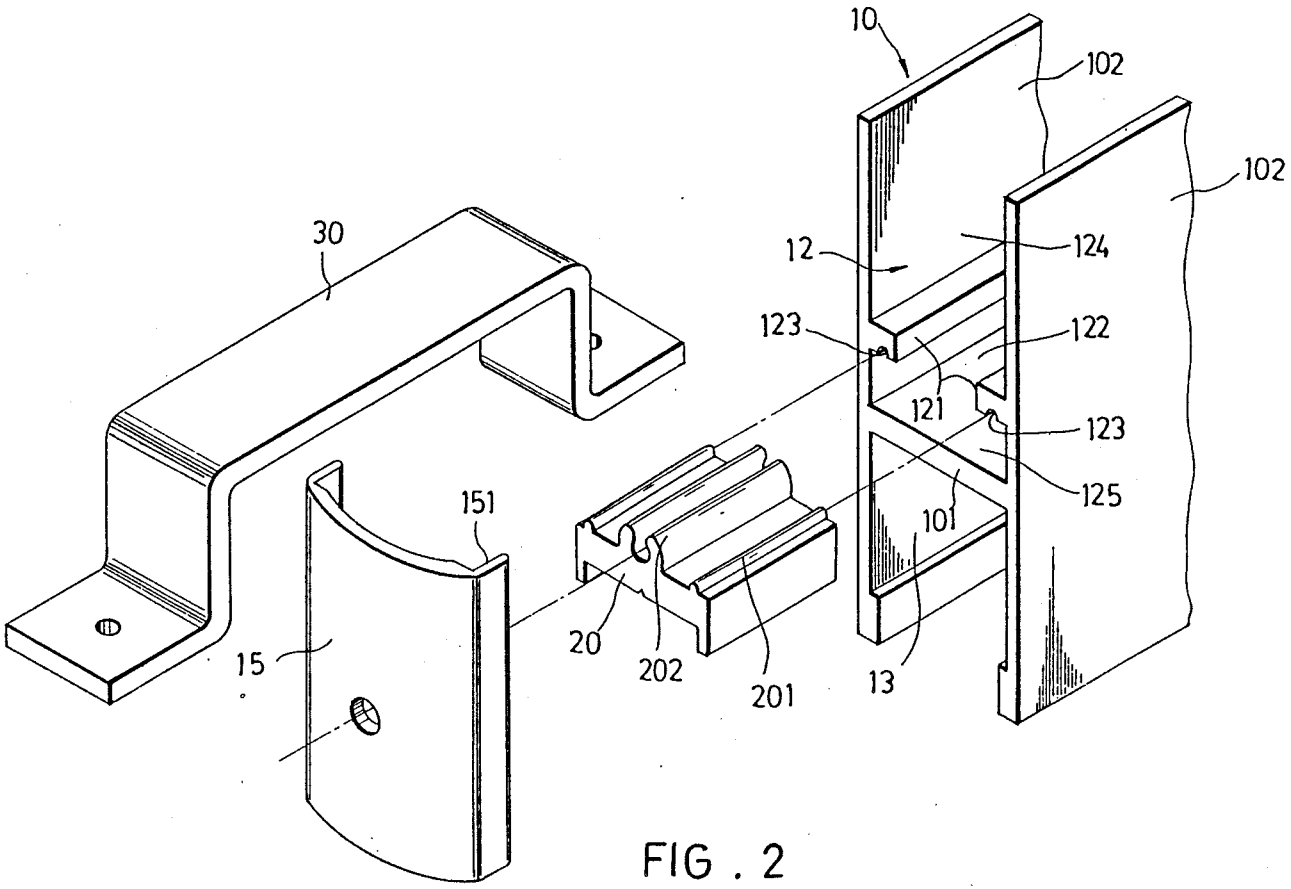
FIG. 2 is an exploded perspective view of a preferred embodiment of the parts of a door according to this invention.

Referring to FIG. 2, an exploded perspective view of a preferred embodiment of the parts of a door according to the present invention is shown. The door includes a frame 10, a slide piece 20 provided in the frame 10, a cover 15 mounted to the side of the frame 10 and a connecting member 30 mounted in said frame 10. The frame 10 is formed with two vertical plates 102 and a partition plate 101 connected between said two vertical plates 102 thereby defining an upper section 12 and a lower section 13 for being mounted to portion of the glass panel 1 (see FIG. 3). In the upper section 12 of the frame 10, two opposing guide rails 121 inwardly protrude from the inner surface of the frame 10 along the length of the frame 10. A long opening 122 is formed between the opposing guide rails 121. In this respect, the upper section 12 of the frame 10 is generally divided into an upper channel portion 124 in which the connecting member 30 is mounted and a lower channel portion 125 for receiving the slide piece 20. In addition, each of the guide rails 121 has a long groove 123 formed in the bottom side thereof and the slide piece 20 has two long protrusions 201 correspondingly projecting therefrom so as to slidably engage with said grooves 123. The slide piece also has a arcuate member 202 integrally formed on the upper portion thereof parallel to the length of the long protrusions 201. The cover 15 has two wing members 151 extended therefrom for clamping onto the vertical plates 102 of the frame 10 respectively.

Figure 3:
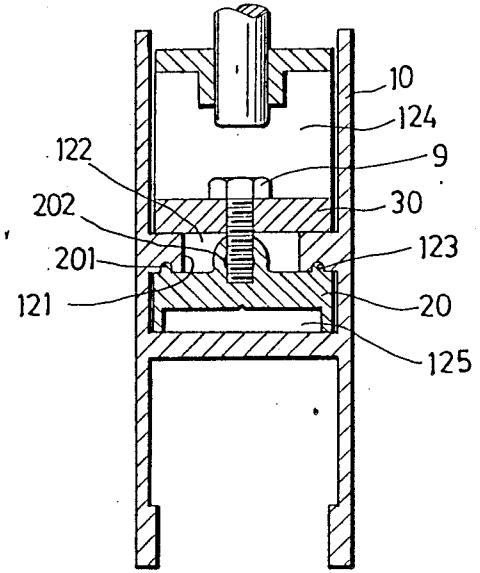
FIG. 3 is a sectional side view of a preferred embodiment of a door of this invention.

Referring to FIG. 3, a sectional side view of the frame portion of the door is shown. The slide piece 20 is slidably provided in the lower channel portion 125 with the protrusions 201 fitting into the grooves 123 of the guide rails 121. The connecting member 30 is placed on the guide rails 121 in the upper channel portion 124 of the frame 10. Two screws 9 respectively pass through the sides of the connecting member 30 and the opening 122 into the arcuate member 202 of the slide piece 20 so as to interconnect the connecting member 30 and said slide piece 20, thus immobilizing the slide piece 20.

Figure 4:
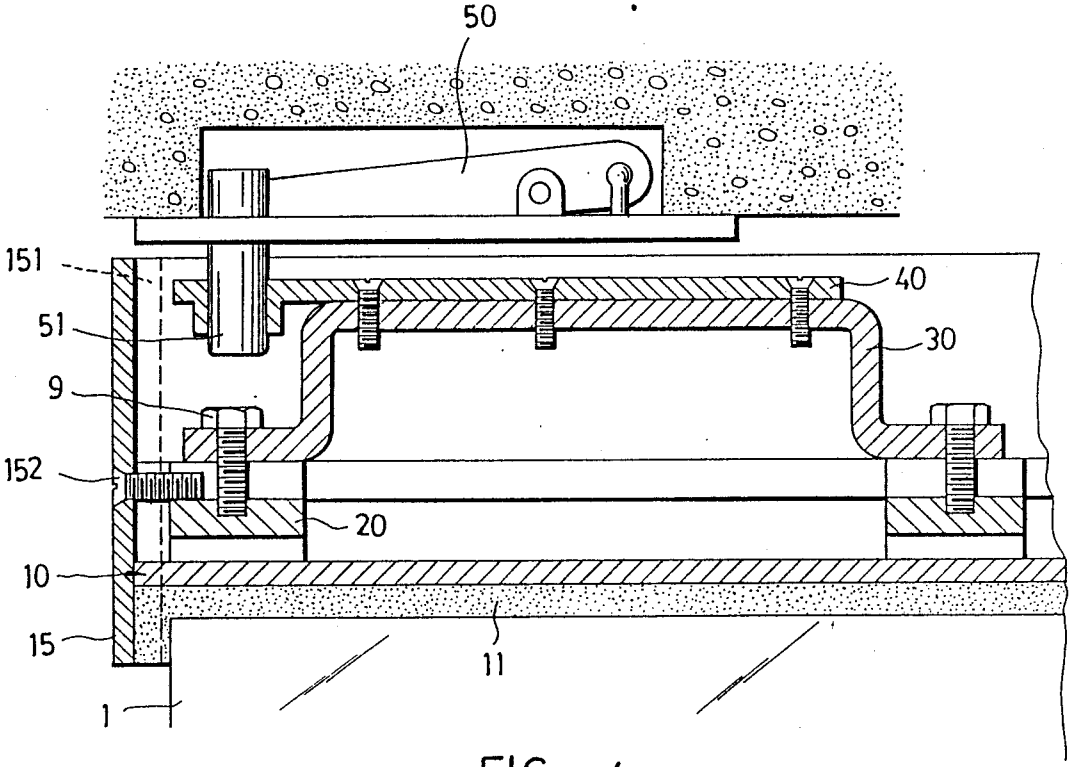
FIG. 4 is a sectional front view of a preferred embodiment of a door of this invention.

Referring to FIG. 4, after the slide piece 20 is connected with the connecting member 30 and is immobilized by the screws 9, the connecting member 30 may be attached to a mounting plate 40, and the mounting plate 40 may be engaged with a pivot pin 51 of a fixing seat 50 which is fixed in the wall in a conventional way. The cover 15 is then mounted to the side of the frame 10 with the wing members 151 clamping onto the vertical plates 102. Finally, a screw 152 passes through cover 15 into the slide piece 20 so as to fix said cover 15 to the frame 10. In this way, the whole mounting operation of the door is completed.

During the mounting operation of the door, if the relative positions of the mounting plate 40 and the pivot pin 51 of the fixing seat 50 are incorrect, thus preventing the pivot engaging with the mounting plate 50, the user can release the screws 9 so as to move the slide piece 20 and the connecting member 30 to a predetermined position where said mounting plate 40 and said pivot pin 51 of said fixing seat 50 may properly engage with each other. The screws 9 then are screwed downward to immobilize the slide piece 20. It is noted that the screws 9 of this invention are screwed down into the slide piece 20 from the upper side of the connecting member 30, while the conventional fixing screws for connecting the frame and the connecting member which are screwed upwardly thereinto from the lower section 13 of the frame 10, are sealed in the silicon rubber and therefore cannot be released for adjusting purpose. Therefore, only the screws 9 can be conveniently released for adjusting.

Figure 5:
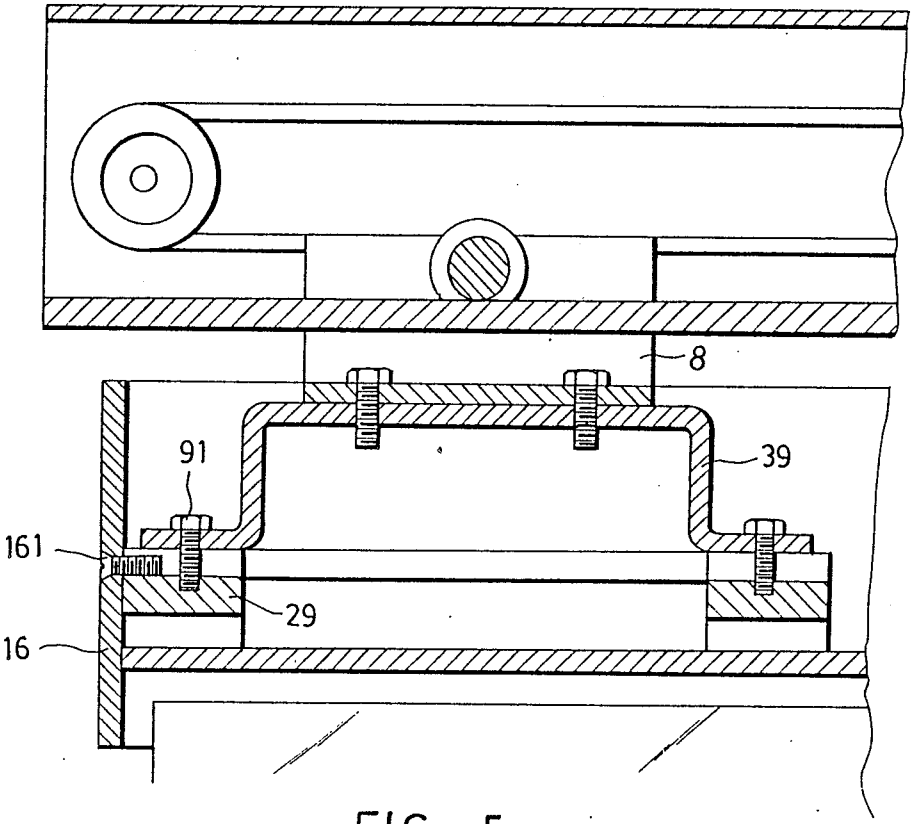
FIG. 5 is a sectional front view of another preferred embodiment of a door of this invention.

Referring to FIG. 5, a sectional view of another preferred embodiment of this invention used with an automatic door is shown. The automatic door has a engaging seat 8 threaded with the connecting member 39. A slide piece 29 is connected with the connecting member 39 by screws 91 in a manner similar to the first embodiment. Therefore, the connecting member 39 may also be moved to a predetermined position so that the automatic door can be properly mounted. The door also has a cover 16 screwed to the slide piece 29 by a screw 161 which is similar to the one in the first embodiment.

With this invention thus explained, it is apparent that numerous modifications and variations can be made without departing from the scope and spirit of this invention. It is therefore intended that this invention be limited only as indicated in the appended claims.

I claim:

1. A system for mounting top and bottom ends of a door between a pair of engaging members respectively mounted at the top and bottom and adjacent one side of an opening in a wall for pivotal movement of the door relative to the engaging members, comprising:

a pair of frame members respectively engaging the top and bottom of said door, each having an H-shaped cross-section configured to form therein a first guide channel for receiving an end of the door and a second guide channel, said second guide channel having opposing guide rails protruding inwardly from its inner sides;

an elongate slide piece disposed in each second guide channel on one side of said guide rails for slideable longitudinal movement relative to said frame member;

a connecting member having an inverted U-shape intermediate horizontally-oriented end portions disposed in each second guide channel on the side of said guide rails opposite said one side, means including a mounting plate secured to the outer surface of each connecting member including a pivot pin projecting therefrom for defining a pivot axis of the door and adapted to be received and journalled in a respective engaging member; and screw means interconnecting each connecting member and a respective slide piece for releasably clamping them against said guide rails for immobilizing said slide piece at an adjusted position relative to said channel at which each pivot pin correctly engages its respective engaging member.

2. A door mounting system as defined in claim 1, wherein each of said guide rails has a longitudinal groove formed in said one side thereof, and wherein each slide piece has parallel longitudinal protrusions formed thereon configured to fit into the grooves in a respective guide rail.

3. A door mounting system as defined in claim 1, wherein each slide piece has an arcuate surface configured to fit into the space defined by said opposing side rails and in which is formed an elongated groove in which said screw means is fastened.

4. A door mounting system as defined in claim 1, wherein said system further comprises:

a cover member having two wing members extending therefrom and spaced apart by a distance substantially equal to the thickness of said frame members, and means for attaching said cover member to an end of said frame member.

5. A system for mounting top and bottom ends of a door between a pair of engaging members respectively mounted at the top and bottom and adjacent one side of an opening in a wall for pivotal movement of the door relative to the engaging members, comprising:

a pair of elongated frame members each having an H-shaped cross section defined by a pair of vertically-oriented side plates interconnected by a horizontally-oriented partition plate to form upper and lower guide channels on opposite sides of said partition plate and each being configured to receive in its lower guide channel a respective end of the door, each upper guide channel having opposing guide rails protruding inwardly from the inner surface of said side plates in spaced, parallel relationship with said partition plate which divide said upper guide channel into upper and lower portions;

an elongate slide piece disposed in the lower portion of the upper guide channel of each frame member and slidably supported on said partition plate, said slide piece having an upwardly-directed surface in which is formed an elongated groove adapted to engage a threaded screw inserted therein at any location along the length of the groove;

a pair of elongated connecting members having an inverted U-shape intermediate horizontally-oriented end portions, each being disposed in the upper portion of the upper guide channel of a respective frame member with its end portions supported on the upper surfaces of said guide rails, the end portions of each member having an opening therethrough for receiving a screw;

a pair of mounting plates each detachably secured to the outer surface of the intermediate portion of a respective connecting member and each having a pivot pin projecting therefrom for defining a pivot axis of the door and adapted to be received and journalled in a respective engaging member; and a pair of screws for each connecting member each having a head and extending through a respective end portion opening, through the space defined by the opposing edges of said guide rails, and threadably engaging the groove formed in a respective slide piece for releasably clamping the connecting member and slide piece against said guide rails for immobilizing the connecting member, the heads of said screws being accessible without interference from a door received in a lower guide channel for enabling convenient adjustment of the position of said connecting member relative to the door to achieve proper engagement of said pivot pins with their respective engaging members.

* * * * *